US006405905B1

(12) United States Patent
Sogaro

(10) Patent No.: US 6,405,905 B1
(45) Date of Patent: Jun. 18, 2002

(54) DOSING DISPENSER FOR FLOWABLE MEDIA

(75) Inventor: Alberto C. Sogaro, Kronberg (DE)

(73) Assignee: Dentaco Dentalindustrie und Marketing GmbH, Bad Homburg (DE)

( * ) Notice: Subject to any disclaimer, the term of this patent is extended or adjusted under 35 U.S.C. 154(b) by 0 days.

(21) Appl. No.: 09/982,642

(22) Filed: Oct. 18, 2001

(30) Foreign Application Priority Data

Oct. 19, 2000 (EP) ..... 00122808

(51) Int. Cl.[7] ..... B65D 88/54
(52) U.S. Cl. ..... 222/321.5; 222/341; 222/377
(58) Field of Search ..... 222/321.5, 321.9, 222/341, 377

(56) References Cited

U.S. PATENT DOCUMENTS

| | | | | |
|---|---|---|---|---|
| 1,611,601 A | * | 12/1926 | McCall | 222/321.5 |
| 4,371,097 A | | 2/1983 | O'Neill | 222/321 |
| 4,728,008 A | * | 3/1988 | Graf et al. | 222/321.5 |

FOREIGN PATENT DOCUMENTS

| | | | |
|---|---|---|---|
| DE | 31 22 330 A | 1/1983 | B65D/47/34 |
| FR | 2 393 279 A | 12/1978 | G01F/11/28 |
| FR | 2 742 487 A | 6/1997 | F04B/9/14 |

* cited by examiner

*Primary Examiner*—Philippe Derakshani
(74) *Attorney, Agent, or Firm*—Quarles & Brady LLP

(57) ABSTRACT

Dosing dispenser for flowable media with a pump that may be manually handled and is integrated in a medium container, with a piston (140), which closes the container (110) fluid-proof to the outside and with a container that is displaced between an upper position and a lower position. A piston chamber (130) adjoins the inner chamber (180) of the container, and is provided in the container bottom (120). The piston chamber has an open upper end aligned to the piston. A connecting channel (150) extends through the piston and provides a fluid-communication to the outside of the container. A spring (160) urges the piston into its upper position, wherein the piston (140), in its upper position, is situated at a distance from the piston chamber (130; 230; 330; 430) and immerses during its downwards movement in its lower position into the piston chamber and, at the same time, closes the adjoining inner chamber (180) of the container from the piston chamber.

13 Claims, 5 Drawing Sheets

DOSING DISPENSER FOR FLOWABLE MEDIA

CROSS REFERENCES TO RELATED APPLICATIONS

This application claims the priority benefit of European patent application EP 00 122 808.9 filed on Oct. 19, 2000.

STATEMENT REGARDING FEDERALLY SPONSORED RESEARCH

Not Applicable

BACKGROUND OF THE INVENTION

The invention concerns a dosing dispenser for flowable media with a manually handled pump integrated in a medium container. In this context, flowable media are primarily fluid and pasty media. Such flowable media are, for example, cosmetic and pharmaceutical fluids, creams and ointments and also liquid and pasty media used in the medical sector, homecare and household, but also industrially used fluid cleaning detergents and the like.

A great number of hand-manipulated pumps are particularly known for the supply of pharmaceutical and cosmetic flowable media; they are, however, not integrated in a medium container in which the medium is stocked. Instead, they are produced as separate units and applied to the container after filling it in a separate handling step, e.g. by screwing-on, snapping-on, beading, curling and the like.

Furthermore, the well-known manually actuated pumps are normally built by a plurality of cooperating components of different materials, like springs, metallic ball valves, pistons, plastic body parts, seals made of elastomers etc.

BRIEF SUMMARY OF THE INVENTION

An object of the invention is to provide a dosing dispenser for flowable media having a simple construction, as few components as possible and a pump which is integrated inside the medium container.

The dosing dispenser according to the invention comprises: an inner chamber for storing the medium, a piston which closes the container in a fluid-proof manner from the outside and which is slidingly movable in a guided manner between an upper position and a lower position within the container, a piston chamber being provided within the container bottom directly adjacent to and preferably below the inner chamber of the container and having an open upper end aligned to the piston, a connecting channel which extends within the piston in the sliding direction thereof and provides a fluid-communication to the outside of the container, a spring which urges the piston into its upper position, a sealing means which seals the opening of the connecting channel directed to the inner chamber of the container as long as the piston is in its upper position, wherein the piston in its upper position, is situated at a distance from the piston chamber and, during its downwards movement in its lower position, immerses into the piston chamber and closes the adjoining inner chamber of the container from the piston chamber.

In order to achieve the possibility for providing multiple dosages using the filled dosing dispenser, the piston chamber has less volume and generally a smaller cross-sectional area than the inner chamber or inner medium reservoir of the container. The inner chamber or reservoir directly adjoins the piston chamber and is preferably arranged above the piston chamber in order to guarantee that the medium automatically refills the piston chamber.

Apart from the fact that in the dosing dispenser, according to the invention, the pump is an integrated component of the medium container, and that the dispenser preferably only comprises a small number of plastic components, it also avoids the otherwise usual check or ball valves. The mounting of the dispenser is easy and does not take time. Although the pump is integrated in the dispenser, the form of the container may be of a great variety.

Furthermore, the dosing dispenser comprises one or more sealing elements, which, as long as the piston is in its upper position, close the inner opening or inlet of the connecting channel facing the inner chamber of the container. The opening of the connecting channel may be a transverse opening provided at a side wall of the piston and the sealing element may be formed by a longitudinal or axial wall section of the container.

If the opening of the connecting channel is an axial opening located at the lower end wall of the piston, the sealing elements preferably may comprise a sealing-plug protruding upwards from the bottom of the piston chamber, which engages into a widened lower section of the connecting channel.

The bottom of the container and the piston chamber integrated therein preferably form a separate unit. This makes the assembly of the dispenser and the filling of the container before mounting the bottom at the container easier.

Preferably, the spring is arranged in an area without media, i.e. an area isolated from the inner chamber of the container and the connecting channel of the piston. In this way, a contact between the spring, which may be produced for example out of steel, and the medium is avoided. This is especially significant for the medical sector where functional safety and purity of the components are indispensable.

Further constructive advantages regarding a better piston guidance result from guiding the piston in a particular longitudinal section. In this case, the spring may be arranged as a helical spring in an isolated axially extending spring chamber between the longitudinal section and the piston.

The spring may not only be a separate pressure spring, but also be provided in the form of one or several spring elements, which are formed in one piece with either the piston or the container in order to press the piston upwards.

A spray head protruding from the upper end of the container may be connected with the upper end of the piston, whenever spraying of the medium is desired.

If several media are to be dispensed, one or several partition walls may extend in longitudinal direction inside the container, which divide the inner chamber of the container and the piston chamber into two or more medium chambers which are isolated from each other in the upper or rest position of the piston.

The dosage ejected per actuation of the dispenser mainly depends on the volume of the piston chamber. The number of possible dosages may be adjusted by changing the volume proportion between the piston chamber and filled inner volume of the container. The discharge pressure depends on the cross section of the connecting channel extending though a major part of the piston and possible discharge channels connecting thereto.

In the following, preferred embodiments of the invention will be further explained with reference to the attached drawings.

DETAILED DESCRIPTION OF THE PREFERRED EMBODIMENTS

Figure 1:
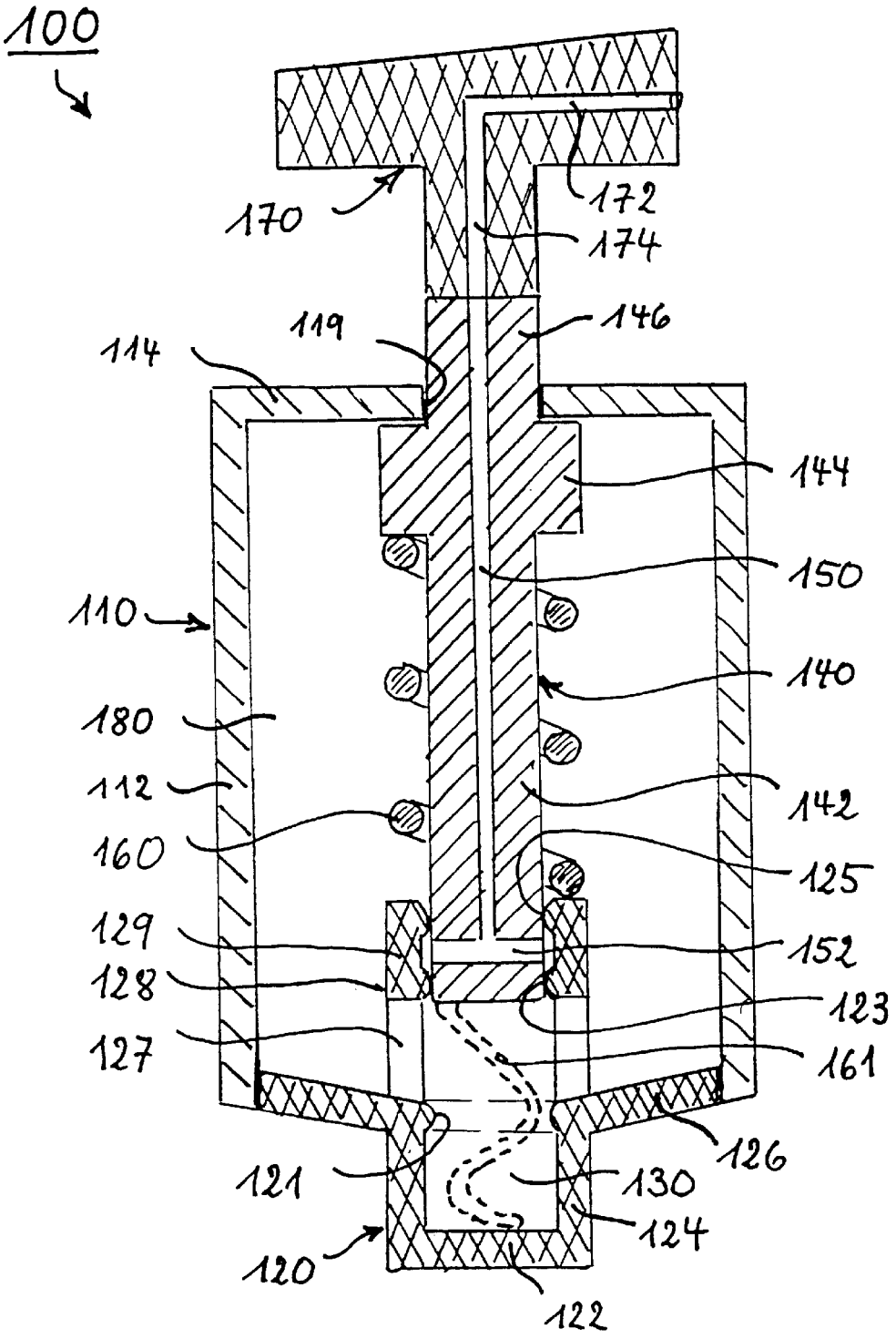
FIG. 1 is a schematic longitudinal sectional side view of a first uncomplicated embodiment of a dosing dispenser according to the invention.

The dosing dispenser 100 shown in FIG. 1 in longitudinal section comprises a medium container 110 formed as a hollow cylinder. The container 110 has an inner chamber 180 which receives a medium to be dispensed. The medium container 110 comprises a circumferential wall 112 that accommodates at its upper end a front wall 114, which extends radially inwardly and has a circular opening 119 in its center part. The lower end of the medium container 110 is closed hermetically by a bottom 120 formed as a separate unit and connected either fixedly or detachable to the circumferential wall 112.

Inside the medium container 110, a piston 140, which is displaceable in longitudinal direction of the circumferential wall 112, is arranged concentrically to the opening 119. The piston 140 protrudes with its upper piston section 146 through the opening 119 upwards to the outside or exterior of the dispenser. The external diameter of the piston section 146 and the bore of the opening 119 are matched in such a way to one another that the piston section 146 is guided liquid-proof or fluid-proof, respectively, within the opening 119 in the front wall 114 so that, in spite of the longitudinal movement of the piston 140, a medium inside the medium container 110 may not flow outwards. In order to improve the fluid-tightness of the medium, depending on the flowability of the medium, the front wall 114 may be additionally extended in the area of the opening 119 in longitudinal direction of the piston 140 like a flange and/or may have a sealing lip facing radially inwards.

The piston section 146 of the piston 140 merges into an adjacent piston section 144, which has, in comparison to the piston section 146, a slightly wider diameter. The piston section 146 is situated below the front wall 114 inside the inner chamber 180 of the medium container 110 and provides an upper stop for the stroke of the piston 140 together with the inner surface of the front wall 114. The piston section 144 adjoins a lower piston section 142 downwards, which again has a smaller diameter than section 144.

The piston 140 comprises a cross-channel 152 next to its lower end, the cross-channel being open towards the lateral circumferential wall of the piston 140. From the cross-channel 152 extends a longitudinal channel 150 upwards until it reaches the upper end of the piston.

Inside the bottom 120 of the medium container 110, a piston chamber 130 with an open upper end is formed having a longitudinal axis, which coincides with that of the piston 140. The piston chamber is defined by a bottom wall 122 and by a circumferential wall 124. A bottom wall 126, which extends radially outwards and slightly tilted upwards, adjoins the circumferential wall 124 at the upper end of the piston chamber 130 and the bottom wall 126 extends towards the circumferential wall 112 of the medium container 110. Furthermore, the circumferential wall 124 of the piston chamber 130 extends upwardly by forming a tube-like section 128. In the lower portion of the tube-like section 128, transverse passages 127 are provided to establish a fluid communication between the piston chamber 130 and the higher situated inner chamber 180 of the medium container 110.

The upper portion 129 of the tube-like section 128 serves to guide the lower section 142 of the piston 140 and likewise to close or shut-off the cross-channel 152 in a fluid-proof manner from the inner chamber 180 as long as the lower end of the piston is located at the height of the section 129. In order to achieve this blockage of the cross channel 152 and at the same time to enable displacement of the piston 140, the outer diameter of the lower piston section 142 is adapted to the inner diameter of the annular section 129 of the tube-like section 128. Additionally, there may also be provided one or several sealing lips at the inner wall of the section 129 which extend radially inwardly, for example, as sealing lips 123 and 125 shown in FIG. 1.

Between the upper side of the section 129 and the lower side of the piston section 144 that protrudes radially outwards over the lower piston section 142, a helical pressure spring 160 surrounds the lower piston section 142. The spring urges the piston against its upper stop. Although the spring 160 is shown as a separate unit and may be, for example, made of steel, there is also the possibility to provide a plastic spring. Preferably, the spring is formed in one single piece with the piston 140 or container bottom 120 or other parts of the container, respectively. As indicated in dashed line in FIG. 1 a spring 161 is provided at the lower end of piston 140 according to such a modification. These modifications are generally applicable to each one of the embodiments of the dosing dispensers according to the invention.

The spring 160 or 161 can be designed such that the spring urges the piston into a defined upper position shown in FIG. 1 without need of an upper stop between the piston and the container. This holds true for each one of the embodiments of the present invention.

The upper position of the piston 140 according to FIG. 1 is the idle position (fully raised or upstroke position) of the piston 140, wherein the transverse opening or cross-channel 152 is at the same height as the portion 129 of the tube-like section 128. Hence, the cross-channel 152 is shut-off from the inner chamber 180 of the medium container. On the other hand, the lowermost end of the lower piston section 142 is situated above the passages 127 so that the piston chamber 130 communicates with the inner chamber 180 of the medium container 110 via said passages 127.

The uppermost end of the upper piston section 146 is either fixedly or detachably connected with a device for the medium release, for example, a spray head 170. The spray head 170 comprises a longitudinal channel 174 aligned with the longitudinal channel 150 of the piston 140 and a cross-channel 172 adjoining channel 150 and leading outwards.

In order to handle the dosing dispenser 100 and starting from the idle position in FIG. 1, the piston 140 is moved downwards in relation to the medium container 110 against the force of the pressure spring 160. For this purpose the spray head 170 connected to the piston 140 is pressed down. Thus, the lowermost end of the piston 140 with the cross-channel 152 provided therein immerses into the piston chamber 130 until it reaches the stop defined by the bottom wall 122. During this stroke of the piston 140, the lower piston section 142 closes the piston chamber 130 from the inner chamber 180 of the medium container 110 and presses a dose of the medium from the piston chamber 130 to the outside by means of displacement into the cross-channel 152 and from there via the longitudinal channels 150 and 174 and the cross-channel 172. The dose of medium constitutes a portion of the flowable medium being stored in the inner chamber 180 of the container.

In order to achieve the above-explained shut-off and displacement processes, a sealing lip 121 is arranged at the upper edge of the piston chamber 130, which extends radially inwardly and engages in a fluid-tight manner the circumferential wall of the lower piston section 142. Moreover, the piston chamber 130 has, in comparison to the external diameter of the lower piston section 142, a slightly larger bore in order to eject amounts of the medium inside the piston chamber 130 via the fluid channels inside the piston 140 and spray head 170 to the outside.

When releasing the pressure manually applied to the spray head 170 from the outside, the piston 140, together with the spray head 170, is pushed upwards by means of the pressure spring 160 and the piston is urged into the idle position as shown in FIG. 1. On the way of the piston 140 upwards, ambient air flows, as a substitute for the ejected medium amount, via the fluid channels provided inside the piston 140 and spray head 170 into the inner chamber 180 of the medium container 110 while, at the same time, the same amount of medium as the ejected dose flows from the inner chamber 180 via the openings 127 into the piston chamber 130.

As it is well known in the art, there are other possibilities to ventilate the container with ambient air such as ventilating openings or ducts between the inside and outside of the container. This modification holds true for each one of the embodiments of the present invention.

The pump and dispense process then may be repeated until the medium stored in the medium container 110 is consumed.

Figure 2:
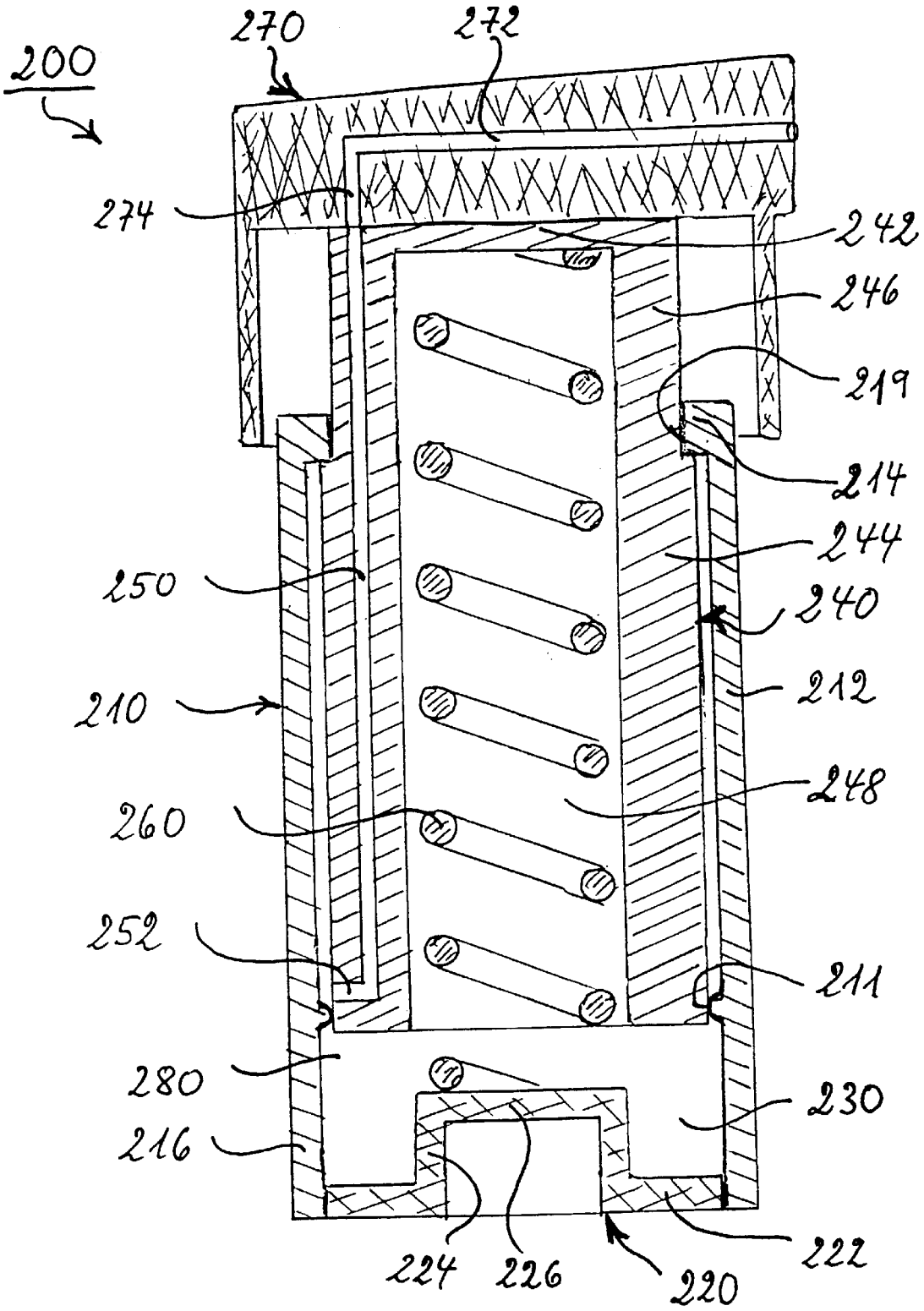
FIG. 2 is a schematic longitudinal sectional side view of a second uncomplicated embodiment of a dosing dispenser according to the invention.

The dosing dispenser 200 shown in longitudinal section in FIG. 2, has a medium container 210 formed as hollow cylinder with an inner chamber 280. The medium container 210 comprises a circumferential wall 212 that merges at its upper end into a front wall 214, which extends radially inwardly and has a circular opening 219 in its center part. The lower end of the medium container 210 is closed hermetically at its bottom 220. The bottom may be formed as separate unit and may either be fixedly or detachably connected to the circumferential wall 212.

A sliding piston 240 is arranged inside the medium container 210 concentrically to the opening 219 in longitudinal direction of the circumferential wall 212. The piston 240 protrudes with its upper piston section 246 through the opening 219 upwards to the outside. The outer diameter of the piston section 246 and the bore of the opening 219 are adapted to one another in such a way that the piston section 246 is guided in a fluid-proof manner by means of the opening 219 in the front wall 214.

The piston section 246 adjoins a piston section 244, which, compared with the piston section 246, provides a slightly larger diameter. The piston section 244 is situated below the front wall 214 inside the inner chamber 280 of the medium container 210 and provides, together with the inner surface of the front wall 214, a stop to limit the stroke of the piston 240 upwardly.

The piston 240 has an inner chamber 248, which has an open lower end which communicates with the inner chamber 280 of the medium container 210. Inner piston chamber 248 is closed at its upper end by an upper front wall 242. The inner chamber 248 of the piston 240 and the inner chamber 280 of the medium container 210 serve to store the medium to be dispensed.

Inside the bottom 220 of the medium container 210, an annular piston chamber 230 with an open upper end is formed. The longitudinal axis of piston chamber 230 coincides with that of the piston 240. The annular piston chamber 230 is defined by a bottom wall 222 downwards and by a lower section 216 of the circumferential wall 212 of the medium container 210 laterally outwards. The annular piston chamber 230 is defined laterally inwards by means of a tube-like wall section 224, which protrudes upwards from the bottom wall 222. The upper end of the tube-like wall section 224 is closed by a bottom wall 226. The tube-like wall section 224 and the bottom wall 226 form together a pot-shaped section of the bottom 220 protruding upwards into the interior of the medium container 210. This pot section is aligned with the inner chamber 248 of the piston 240 and has an outer diameter corresponding to the inner diameter of the inner chamber 248.

The piston 240 comprises next to its lower end a cross-channel 252 with an opening towards the lateral circumferential wall of the piston 240. From the cross-channel 252, a longitudinal channel 250 extends upwards up to the upper end of the piston 240.

Between the upper side of the bottom wall 226 and the lower side of the upper front wall 242 of the piston 240, a helical pressure spring 260 is provided in order to urge the piston 240 against its upper stop.

The upper position of the piston 240 in FIG. 2 shows the idle position of the piston 240, wherein the transverse opening 252 is arranged above a sealing lip 211. The sealing lip 211 extends radially inwardly from the circumferential wall 212 inside the medium container and closes the transversal opening 252 from the inner chambers 248 and 280 in a fluid-proof manner.

On the other hand, the lowermost end of the piston 240 is situated above the pot-shaped upwards-protruding section of the bottom 220 so that the piston chamber 230 communicates with the inner chamber 280 of the medium container 210 and the inner chamber 248 of the piston 240.

The uppermost end of the upper piston section 246 provides an either fixed or detachable device for the medium release, for example a spray head 270. The spray head 270 comprises a longitudinal channel 274 aligned with the longitudinal channel 250 of the piston 240 and a cross-channel 272 adjoining channel 274 and leading to the outside.

In order to actuate the dosing dispenser 200 starting from the idle position shown in FIG. 2, the piston 240 is pressed down by means of the spray head 270 connected to the piston 240 against the force of the pressure spring 260 and relatively to the medium container 210. Thus, the lowermost end of the piston 240 with the transversal opening 252 provided therein immerses into the piston chamber 230 until it reaches the stop at the bottom wall 222. The annular piston chamber 230 is adapted to the annular cross-section of the lower piston section. During this stroke of the piston 240, the lower piston section closes the piston chamber 230 from the inner chamber 280 of the medium container 210 and from the inner chamber 248 of the piston 240 and urges a dose of the medium outwardly the piston chamber 230 by means of displacement into the cross-channel 252 and from there via the longitudinal channels 250 and 274 and the cross-channel 272. The medium is stored in inner chambers 248 and 280.

The above-explained shut-off and displacement process is promoted by a radially inwardly protruding sealing lip 211 and a fluid-proof engagement between the inner wall of the piston section 244 and the tube-like wall section 224 and by the fact that the piston chamber 230, in comparison to the outer diameter of the lower piston section, has a slightly larger bore in order to eject the amount of the medium inside the piston chamber 230 via fluid channels of the piston 240 and spray head 270 outwards.

When the manually applied pressure upon the spray head 270 is released, the piston 240, together with the spray head 270, is pushed upwards by means of the pressure spring 260 and into the idle position shown in FIG. 2. On the way upwards of the piston 240, ambient air flows, as a substitute for the ejected medium amount, via the fluid channels provided inside the piston 240 and spray head 270 into the inner chambers 280 and 248 while, at the same time, a medium amount corresponding to the dispensed dose flows from the inner chambers 280 and 248 into the piston chamber 230. The pump and dispense processes may be repeated until the medium amount of the medium container 210 is consumed.

Figure 3:
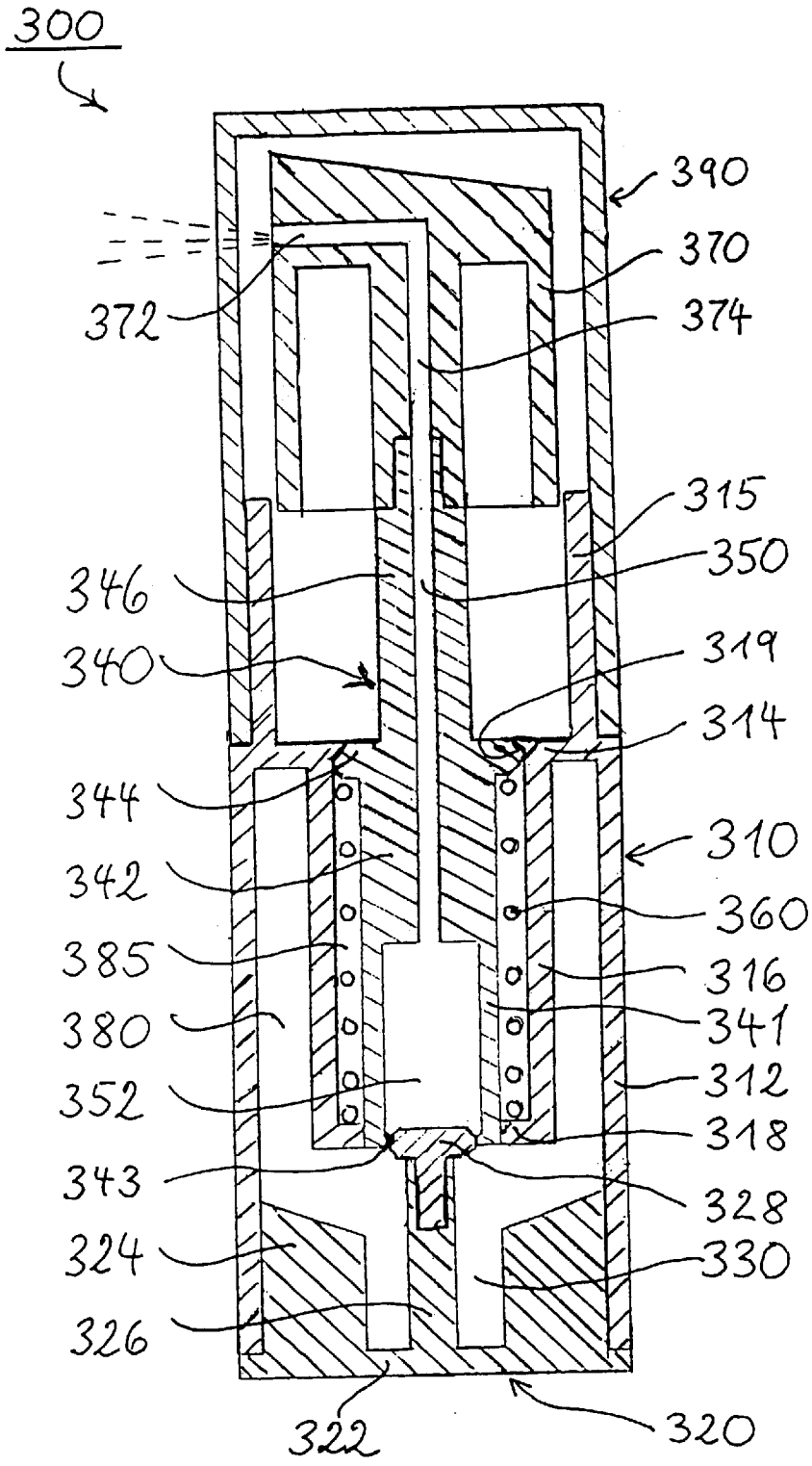
FIG. 3 is a longitudinal sectional view of a first embodiment of a further development of the dosing dispenser according to the invention.

The dosing dispenser 300, shown in longitudinal section in FIG. 3, is a further developed embodiment of the invention. The dosing dispenser 300 includes a substantially hollow cylindrical medium container 310 with an inner chamber 380, which is to stock the medium to be dispensed. The medium container 310 presents a circumferential wall 312 that merges at its upper end into a radially inwards extending front wall 314 with a circular opening 319 in the central portion of wall 314. Around the opening 319 a tube-like section 316 freely protruding into the inner chamber 380 extends from the lower side of the front wall 314. The inner diameter of section 316 is slightly larger than the bore of the opening 319 so that the front wall 314 protrudes radially inwardly beyond the tube-like section. At the lower end of the tube-like section 316 an annular flange 318 protruding radially inwardly is formed. A further tube-like section 315 extends from the upper side of the front wall 314 upwards. Section 315 has a slightly smaller outer diameter than the circumferential wall 312.

A piston 340 reciprocally movable in longitudinal direction of the circumferential wall 312 is arranged concentrically to the opening 319 inside the medium container 310. The piston 340 protrudes with an upper piston section 346 through the opening 319 upwards into an outer space surrounded by the tube-like section 315. A relatively short, flange-shaped piston section 344 adjoins the piston section 346 of the piston 340. The piston section 344 is situated below the front wall 314 and has an outer diameter adapted to the inner diameter of tube-like section 316 so that the piston section 344 is guided by the inner circumferential wall of section 316 during its sliding movement. On the other hand, the outer diameter of the piston section 344 is dimensioned such that it provides a stop, together with the projecting end of the front wall 314 adjoining the opening 319, in order to limit the stroke of the piston 340 upwards. Furthermore, the projecting end of the front wall 314 adjoining the opening 319 is formed in respect to size and material in such a manner that, during the assembly of the dosing dispenser 300, the piston section 344 may be snapped over this projecting end.

The piston section 344 downwardly adjoins a lower piston section 342 with a smaller outer diameter, which is adapted to the bore of the annular flange 318 such that the piston section 342 is guided in a fluid-proof manner by the flange 318 so that a medium inside the medium container 310 may not flow into a chamber 385 defined by the tube-like section 316 and lower piston section 342 in spite of the longitudinal displacement of the piston 340.

The piston 340 comprises a longitudinal channel 350, which continuously extends from the lower to the upper end of the piston 340 and merges at its lower end into a cylindrical chamber 352 with a larger inner diameter.

The lower end of the medium container 310 is hermetically closed by a bottom 320, which may be formed as separate unit and may be connected either fixed or detachable to the circumferential wall 312. In the bottom 320 of the medium container 310 an upwardly extending piston chamber 330 with an open upper end is formed the longitudinal axis of which coincides with that of the piston 340. The piston chamber 330 is defined by a bottom wall 322 in downwards direction and laterally by a circumferential wall 324 which extends from the upper end of the piston chamber 330 radially outwardly and slightly tilted in upwards direction until it reaches the circumferential wall 312 of the medium container 310.

From the center of the bottom wall 322 and inside the piston chamber 330 a sealing piston 326 protrudes upwardly, comprising at its upper end a sealing-plug 328. The sealing-plug 328 serves to close in fluid-proof manner the chamber 352 from the inner chamber 380 of the dosing dispenser 300 as long as the lowest piston end happens to be at the same height as the sealing-plug 328. Since the outer diameter of the sealing-plug 328 is slightly smaller than the inner diameter of the chamber 352, the lower edge 343 of a circumferential wall 341 surrounding the chamber 352 protrudes radially inwardly over a short distance. Alternatively, a sealing lip protruding radially inwardly may be provided at the lower end of the chamber wall 341.

Between the upper side of the flange 318 and the lower side of the piston section 344 protruding radially outwards beyond the lower piston section 342, a helical-shaped pressure spring 340 is provided surrounding the lower piston section 342. The spring serves to press the piston 340 against its upper stop. The pressure spring 360 is situated inside the chamber 385, which closes it in a fluid-proof manner from the inner chamber 380 so that the pressure spring 360 does not get into contact with the medium inside the inner chamber 380.

The upper position of the piston 340 in FIG. 3 shows the idle position of the piston 340, the end of the chamber 352 being open at its lower end is at the same height as the sealing-plug 328, so that the chamber 352 is closed from the inner chamber 380 of the medium container. On the other hand, the lowest end of the lower piston section 342 is situated above the circumferential wall 324 of the piston chamber 330 so that the piston chamber 330 communicates via the gap between the flange 318 and the circumferential wall 324 with the inner chamber 380 of the medium container 310.

The uppermost end of the upper piston section 346 is connected to a tightly fixed or detachable device for the medium release, for example a spray head 370. The spray head 370 provides a longitudinal channel 374 aligned with the longitudinal channel 350 of the piston 340 and a cross-channel 372 adjoining channel 374 and leading to the outside.

In order to handle the dosing dispenser 300 and starting from the idle position as in FIG. 3., the piston 340 is pressed down by means of the spray head 370 connected to the piston 340 relatively to the medium container 310 against the force of the pressure spring 360 after having removed a cap 390 placed upon the tube-like section 315. Thus, the lowest end of the piston 340 with the chamber 352 provided therein immerses into the piston chamber 330 until it reaches the stop at the bottom wall 322. During this displacement of the piston 340 downwards, the lower piston section 342 closes the piston chamber 330 from the inner chamber 380 of the medium container 310 and presses or urges a dose of the medium from the piston chamber 330 by means of displacement into the chamber 352 and from there via the longitudinal channels 350 and 374 and the cross-channel 372 outwards.

In order to obtain the above-mentioned blockage and displacement processes, the outer diameter of the lower piston section 342 is adapted to the inner diameter of the piston chamber 330 in such a way, that the circumferential wall of the piston section 342 engages in a fluid-tight manner the inner circumferential wall 324 of the piston chamber 330. Furthermore, the sealing-plug 328 has in comparison with the inner diameter of the chamber 352 such an outer diameter that the medium may flow upwards while the piston 340 is pressed downwards through a clearance between the sealing-plug 328 and the inner circumferential wall of the chamber 352. Moreover, the sealing-plug 326 is dimensioned in such that only a very small annular slot or clearance remains between the outer circumference of the sealing-plug 326 and the inner circumferential wall of the chamber 330, whereas a relatively wide annular clearance is provided between the outer circumference of the sealing-plug 326 and the inner circumferential wall of the chamber 330. This wider annular clearance is filled, when pressing down the piston 340, by the circumferential wall 341 of the chamber 330.

When the manually applied pressure on the spray head 370 is released, the piston 340, together with the spray head 370, is pushed upwards by the pressure spring 360 and into the idle position as shown in FIG. 3. On the way of the piston 340 upwards, ambient air flows, as a substitute for the ejected medium amount, via the fluid channels and the chamber 352 provided inside the piston 340 and spray head 370 into the inner chamber 380 of the medium container 310 while, at the same time, a medium amount like the dispensed dose flows from the inner chamber 380 into the piston chamber 330. The pump and dispense processes may be then repeated until the medium amount of the medium container 310 is consumed.

Figure 4:
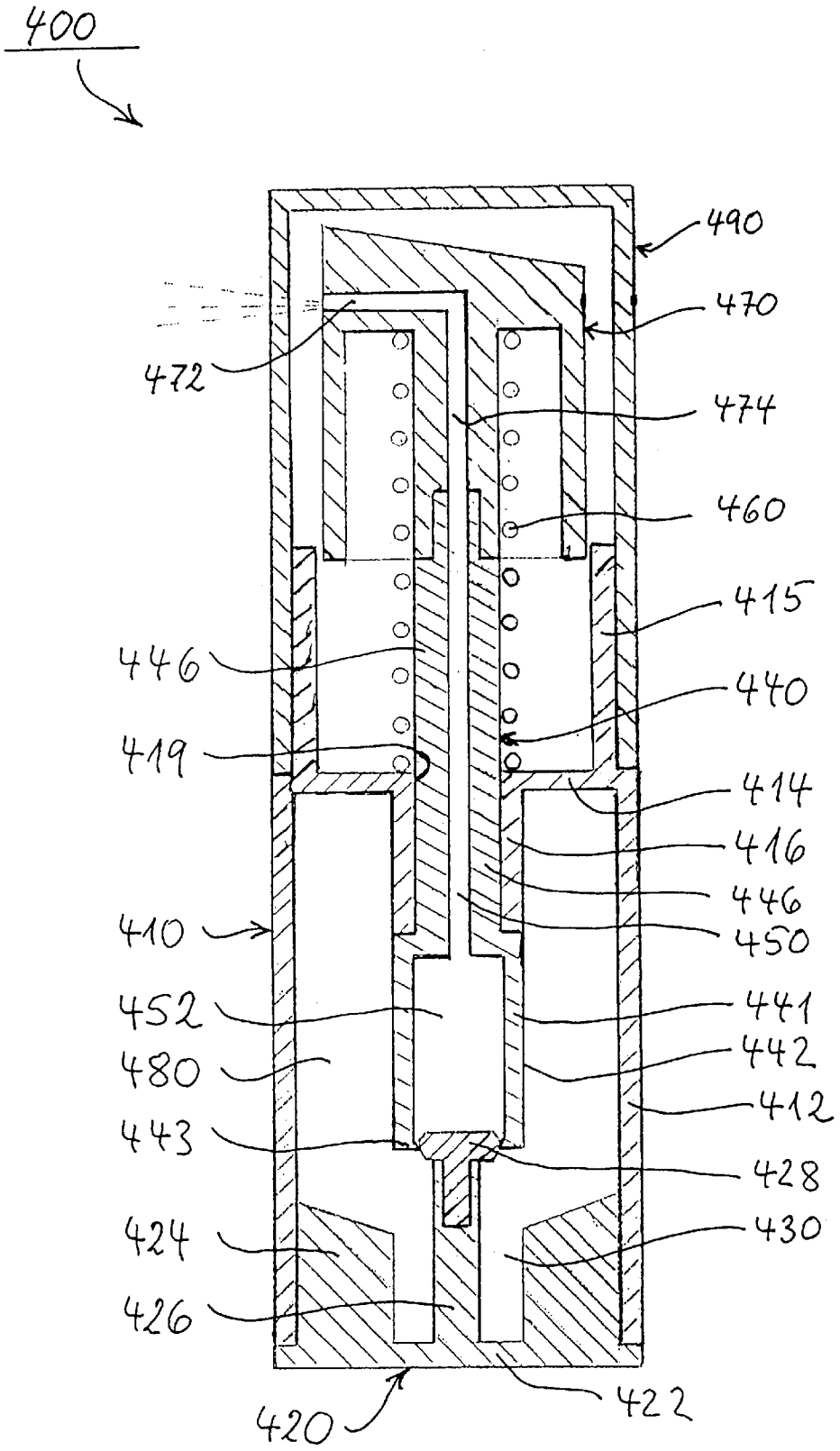
FIG. 4 is a longitudinal sectional view of a second embodiment of the further development of the dosing dispenser according to the invention.

The dosing dispenser 400, shown in longitudinal section in FIG. 4, shows a second further developed embodiment of the invention and substantially presents the same construction as the dosing dispenser 300 and is also handled in the same way. The only thing that differs is the position of the pressure spring as results from the comparison between FIGS. 3 and 4.

The dosing dispenser 400 provides a substantially hollow cylindrical medium container 410 with an inner chamber 480, which serves as reservoir to stock the medium to be dispensed. The medium container 410 comprises a circumferential wall 412 with front wall 414 and a central circular opening 319. Around the opening 419 a tube-like section 416 protrudes into the inner chamber 480 from the lower side of the front wall 414. Section 416 has an inner diameter corresponding to the bore of the opening 419. A tube-like section 415 extends from the upper side of the front wall 414 and has a slightly smaller outer diameter than the circumferential wall 412.

A displaceable piston 440 is arranged concentrically to the section 416 inside the medium container 410. The piston 440 has an upper piston section 446 with an outer diameter that is adapted to an inner diameter of the section 416. This adaptation is such that the piston section 446 is guided in a fluid-tight manner along the inner circumferential wall of the section 416. Therefore, the medium inside the medium container 410 may not flow outwards in spite of a longitudinal displacement of the piston 440. The piston section 446 protrudes through the opening 419 upwards into an outer chamber surrounded by a further tube-like section 415.

A piston section 442 with a bigger diameter joins the piston section 446 of the piston 440, the upper shoulder of which, together with the lower side of the joint 416, provides a stop to limit the shift of the piston 440 upwards.

The piston 440 comprises a longitudinal channel 450, which continuously extends from the lower to the upper end of the piston 440 and merges at its lower end into a cylindrical chamber 452 with a larger inner diameter.

The lower end of the medium container 410 is hermetically closed by a bottom 420, which may be formed as separate component and may be connected either tightly or detachable to the circumferential wall 412. In the bottom 420 of the medium container 410 an upwards-extending piston chamber 430 with an open upper end is formed whose longitudinal axis coincides with that of the piston 440. The piston chamber 430 is defined by a bottom wall 422 in downward direction and a circumferential wall 424 on its lateral. The circumferential wall 424 extends from the upper end of the piston chamber 430 radially outwards and slightly tilted upwards until it reaches the circumferential wall 412 of the medium container 410.

From the center of the bottom wall 422 and inside the piston chamber 430 a sealing piston 426 protrudes upwards, comprising at its upper end a sealing-plug 428. The sealing-plug 428 is provided to close the chamber 352 in a fluid-proof manner from the inner chamber 480 of the dosing dispenser 400 as long as the lowest piston end is at the same height as the sealing-plug 428. Since the outer diameter of the sealing-plug 428 is slightly smaller than the inner diameter of the chamber 452, the lower end 443 of a circumferential wall 441 surrounding the chamber 452, protrudes radially inwardly over a short distance. Alternatively, a sealing lip protruding radially inwardly may be provided at the lower end of the chamber wall 441.

The uppermost end of the upper piston section 446 provides a tightly fixed or detachable device for the medium release, for example a spray head 470. The spray head 470 provides a longitudinal channel 474 aligned together with the longitudinal channel 450 of the piston 440 and a cross-channel 472 joining thereto and leading to the outside.

Between the upper side of the front wall 414 and the lower side of the spray head 470, which protrudes radially outwards beyond the upper piston section 446, a helical-shaped pressure spring 460 surrounding the upper piston section 446 is provided in order urge the piston 440 against its upper stop. The pressure spring 460 is situated above the tube-like section 416, which closes the inner chamber 480 fluid-proof so that the pressure spring 460 does not get in contact with the medium inside the inner chamber 480.

The upper position of the piston 440 in FIG. 4 shows the idle position of the piston 440, wherein the end of the chamber 452 being open at its lower end is at the same height as the sealing-plug 428 so that the chamber 452 is be closed from the inner chamber 480 of the medium container 410. On the other hand, the lowest end of the lower piston section 442 is situated above the circumferential wall 424 of the piston chamber 430 so that the piston chamber 430 communicates via the gap between the flange 418 and the circumferential wall 424 with the inner chamber 480 of the medium container 410.

In order to handle the dosing dispenser 400 and starting from the idle position as in FIG. 4., the piston 440 is pressed downwards by means of the spray head 470 against the force of the pressure spring 460 relative to the medium container 410, after having taken off a cap 490. Thus, the lowest end of the piston 440 comprising the chamber 452 immerses into the piston chamber 430 until it reaches the stop at the bottom wall 422. During this displacement of the piston 440 downwards, the lower piston section 442 closes the piston chamber 430 from the inner chamber 480 of the medium container 410 and presses a dose of the medium from the piston chamber 430 by means of displacement into the chamber 452 and from there via the longitudinal channels 450 and 474 and the cross-channel 472 outwards.

In order to obtain the above-mentioned blockage and displacement processes, the outer diameter of the lower piston section 442 is again adapted to the inner diameter of the piston chamber 430 in such a way that the circumferential wall of the piston section 442 engages in a fluid-proof manner the inner circumferential wall 424 of the piston chamber 430. Furthermore, the sealing-plug 428 has, in comparison with the inner diameter of the chamber 452, such an outer diameter that the medium may flow upwards through a clearance between the sealing-plug 428 and the inner circumferential wall of the chamber 452 while the piston 440 is pressed downwards. Moreover, the sealing-plug 426 is designed in such a way that only a very small annular slot or clearance remains between the outer circumference of the sealing-plug 426 and the inner circumferential wall of the chamber 430, whereas a relatively wide annular clearance is provided between the outer circumference of the sealing-plug 426 and the inner circumferential wall of the chamber 430. This relatively wide clearance is filled while pressing down the piston 440 by the circumferential wall 441 of the chamber 430.

When the pressure upon the spray head 470 is released, the piston 440, together with the spray head 470, is pushed upwards by the pressure spring 460 and into the idle position as shown in FIG. 4. On the way of the piston 440 upwards, ambient air flows, as a substitute for the ejected medium amount, via the fluid channels and the chamber 452 provided inside the piston 440 and spray head 470 into the inner chamber 480 of the medium container 410 while, at the same time, a medium amount like the dispensed dose flows from the inner chamber 480 into the piston chamber 430. The pump and dispense processes then may be repeated until the medium amount of the medium container 410 is consumed.

Figure 5:
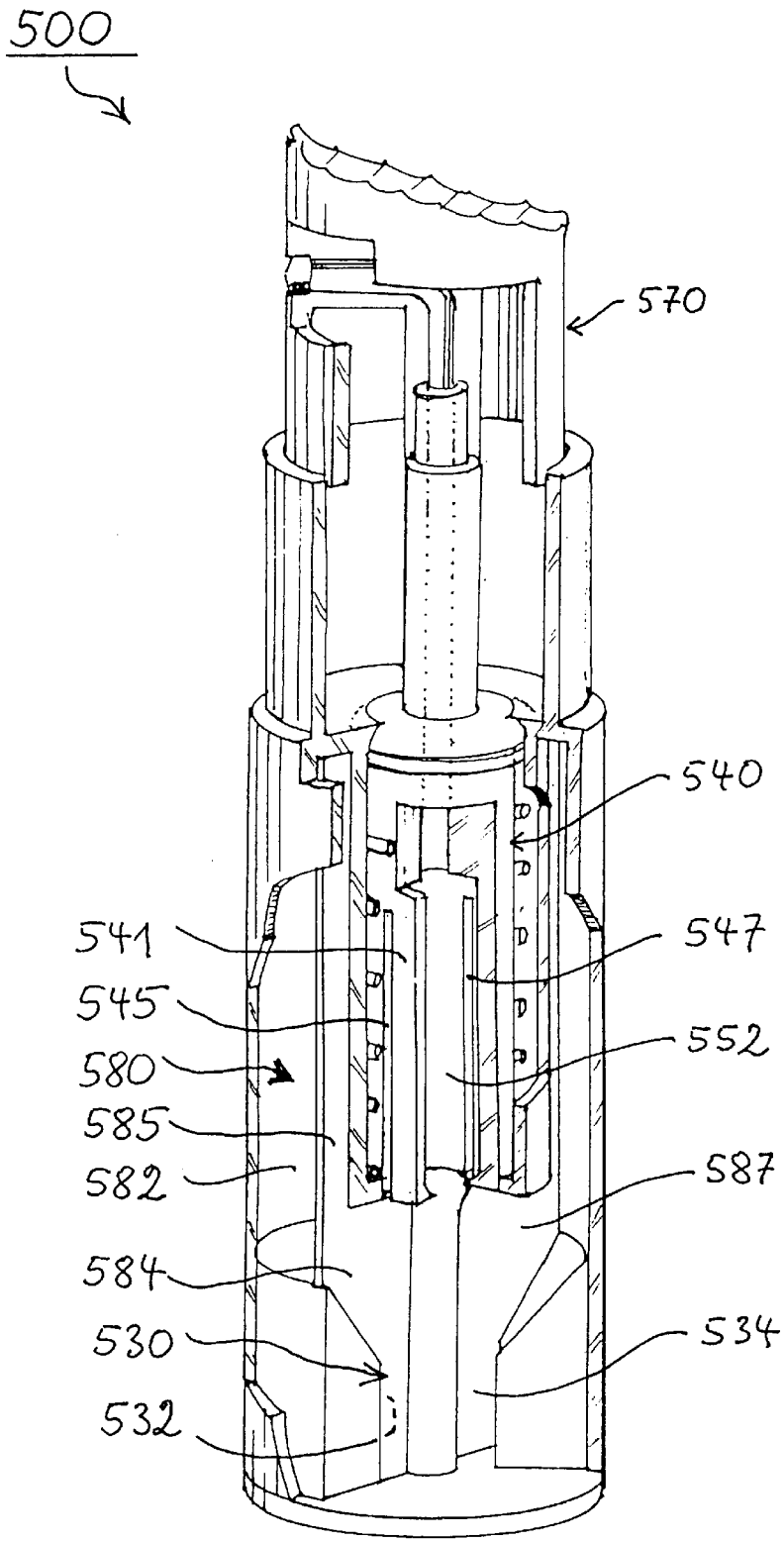
FIG. 5 is a perspective partial cut-away view of a modification of the embodiment according to FIG. 3.

The dosing dispenser 500 in perspective, partial cross section as in FIG. 5 is another modified embodiment of the dosing dispenser 300 as shown in FIG. 3. The dosing dispenser 500 substantially corresponds to the dosing dispenser 300 and is also handled in the same way.

The dosing dispenser 500, however, provides the possibility to stock two different flowable media separately from one another, only combining them after their outlet. For this purpose, the inner chamber 580 and the piston chamber 530 are divided by means of a first longitudinal wall 585 and a second longitudinal wall 587 into a first half of the inner chamber 582 and a first half of the piston chamber 532 aligned thereto as well as into a second half of the inner chamber 584 and a second half of a piston chamber 534 aligned thereto. Moreover, the chamber wall 541 of the chamber 552 comprises a first continuous slot 545, which is aligned to the first longitudinal wall 585, and a second continuous slot 547, which is aligned to the second longitudinal wall 587. The slots extend over the whole length of the wall 541 so that the piston 540 can be moved downwards without being blocked by the lower portions of the longitudinal walls 585 and 587.

While moving the piston 540 downwards, the medium amounts inside the piston chamber halves are urged by displacement into the chamber 552 and pressed outwards from there via the fluid channels inside the piston 540 and spray head 570. On their way outwards, the media can be mixed while being discharged. In the same way, three or even more different media may be separately stocked and mixed while being discharged.

I claim:

1. A dosing dispenser for flowable media with a pump that may be manually handled and is integrated in a medium container, comprising:

an inner chamber (180; 280; 380; 480) for storing a medium, a piston (140; 240; 340; 440), which closes the container (110; 210; 310; 410) in a fluid-proof manner from the outside and which is slidingly movable in a guided manner between an upper position and a lower position within the container, a piston chamber (130; 230; 330; 430) being provided within the container bottom (120; 220; 320; 420) directly adjoining the inner chamber (180; 280; 380; 480) of the container and having an open upper end aligned to the piston, a connecting channel (150; 250; 350; 450), which extends within the piston in the sliding direction thereof and provides a fluid-communication to the outside of the container, a spring (160; 161; 260; 360; 460), which urges the piston into its upper position, a sealing means (123, 125; 211; 328,343; 428, 443), which seals the opening of the connecting channel (150; 250; 350; 450) directed to the inner chamber (180; 280; 380; 480) of the container (110; 210; 310; 410) as long as the piston (140; 240; 340; 440) is in its upper position, wherein the piston (140; 240; 340; 440), in its upper position, is situated at a distance from the piston chamber (130; 230; 330; 430) and, during its downwards movement in its lower position, immerses into the piston chamber and shuts off the adjoining inner chamber (180; 280; 380; 480) of the container (110; 210; 310; 410) from the piston chamber.

2. The dosing dispenser according to claim 1, further comprising a tube-like section (128) extending upwards from the piston chamber (130) into the inner chamber (180) of the container, which tube-like section (128) guides the piston (140) and provides the sealing means (123,125).

3. The dosing dispenser according to claim 1 wherein the opening (152; 252) is situated on a sidewall of the piston (140; 240) and the sealing means (123, 125; 211) are formed by a wall section (129; 212) of the container (110; 210).

4. The dosing dispenser according to claim 1 wherein the opening is arranged on the lower front wall of the piston (340; 440) and the sealing means (328; 428) comprises a sealing-plug (326; 426) protruding upwards from the bottom (322; 422) of the piston chamber (330; 430) and engaging into an enlarged lower section (352; 452) of the connecting channel (350; 450).

5. The dosing dispenser according to claim 1 wherein the bottom (120; 220; 320; 420) of the container (110; 210; 310; 410) together with the piston chamber (130; 230; 330; 430) is formed as a separate unit.

6. The dosing dispenser according to claim 1 wherein the spring (360; 460) is arranged in an area separated from the inner chamber (380; 480) of the container (310; 410) and the connecting channel (350; 450) of the piston (340; 440) which area is free of media.

7. The dosing dispenser according to claim 1 wherein the piston (360; 460) is guided inside a longitudinal section (316; 416) of the container (310; 410) surrounded by the inner chamber (380; 480) of the container.

8. The dosing dispenser according to claim 7 wherein the spring (360) is a helical spring and is arranged inside a spring chamber (385) being provided between the piston (340) and the longitudinal section (316) of the container (310).

9. The dosing dispenser according to claim 1, further comprising a spray head (170; 270; 370; 470) connected to the upper end of the piston (140; 240; 340; 440) and protruding over the upper end of the container (110; 210; 310; 410).

10. The dosing dispenser according to claim 1, further comprising a partition wall (585, 587) extending in longitudinal direction of the container (510) inside thereof and dividing the inner chamber (580) of the container and the piston chamber (530) into two medium chambers (582, 532 and 584, 534).

11. The dosing dispenser according to claim 1 wherein the spring (161) is arranged between the lower end of the piston (140) and the piston chamber (130).

12. The dosing dispenser according to claim 1 wherein the sealing means (123, 125; 328, 343; 429, 443) is provided at an inner wall (212) of container (210) or at container parts (128; 326; 426) which extend into the inner chamber (180; 380; 480) of the container.

13. The dosing dispenser according to claim 1 wherein a tube-like section (128,129) is provided for guiding said piston (140) and for providing said sealing means (123,125) and wherein said tube-like section (128, 129) extends from a circumferential wall (124) of said piston chamber (130).

* * * * *